United States Patent [19]

Morganson

[11] 4,090,974

[45] May 23, 1978

[54] CARPET CLEANING COMPOSITION

[75] Inventor: Stephen A. Morganson, Inver Grove Heights, Minn.

[73] Assignee: FMC Corporation, Philadelphia, Pa.

[21] Appl. No.: 693,993

[22] Filed: Jun. 8, 1976

Related U.S. Application Data

[63] Continuation-in-part of Ser. No. 468,769, May 10, 1974, abandoned.

[51] Int. Cl.[2] ..... C11D 3/06; C11D 7/16; C11D 11/00

[52] U.S. Cl. ..... 252/135; 252/89 R; 252/890 B; 252/DIG. 1; 134/21; 134/22 R

[58] Field of Search ..... 252/135, DIG. 1, 89, 252/99; 134/21, 22 R

[56] References Cited

U.S. PATENT DOCUMENTS

| | | | |
|---|---|---|---|
| 3,913,555 | 10/1975 | Mummer | 252/135 X |
| 3,966,627 | 6/1976 | Gray | 252/135 X |
| 4,001,130 | 1/1977 | Schinzel et al. | 252/135 X |

*Primary Examiner*—Mayer Weinblatt
*Attorney, Agent, or Firm*—Christine M. Miles; Frank Ianno

[57] ABSTRACT

There is disclosed a carpet cleaning concentrate particularly suitable for use in connection with carpet steam cleaning machines which comprises 75 to 95% by weight sodium tripolyphosphate with minor amounts of sodium metasilicate pentahydrate, a low foaming nonionic surfactant and, generally, some water.

5 Claims, No Drawings

CARPET CLEANING COMPOSITION

The application is a continuation-in-part of my prior copending application Ser. No. 468,769, filed May 10, 1974 now abandoned.

This invention relates to compositions useful for cleaning carpeting. More particularly, the invention relates to compositions containing substantial quantities of sodium tripolyphosphate which are specially formulated for use in connection with carpet steam cleaning equipment.

Conventional aqueous based carpet cleaning formulations typically contain 85 to 90% water and 10 to 15% of a high foaming surfactant such as sodium lauryl sulfate or sodium lauroyl sarcosinate and are used by applying and scrubbing the solution into the carpeting. After drying, the powdery residue is removed with a conventional vacuum cleaner.

An improved technique for cleaning of carpeting, particularly on a commercial scale, employs steam cleaning machines which function by spraying a hot, that is, about 140° to 180° F, aqueous solution under pressure onto the carpeting. The solution is immediately removed with a vacuum device so that the total contact time of the solution with the carpeting is only a few seconds. Thus, conventional carpet formulations, which generally contain substantial proportions of anionic surfactants, are not useful in connection with carpet steam cleaning equipment, since the solution is maintained under pressure and excessive foaming will result.

Formulations to be used in connection with such carpet steam cleaning equipment must have excellent anti-redeposition properties, should be highly alkaline for general cleaning efficiency, and should exhibit some surfactant activity with foam being minimized, because the cleaning solution is maintained under pressure in the equipment.

In accordance with the present invention, there is provided a carpet cleaning process and concentrate for use in connection with carpet steam cleaning machines which comprises, in percent by weight of the total composition:

(a) sodium tripolyphosphate, 75 to 95%;
(b) sodium metasilicate pentahydrate, 3 to 10%;
(c) a low-foaming nonionic surfactant, 0.5 to 10%; and
(d) water, 0 to 5%.

Granular sodium tripolyphosphate of varying particle size and bulk density may be employed, with either spray dried or rotary dried particles or granules being suitable. Preferably, the composition will contain about 85 to 95%, most preferably about 88 to 92% by weight of sodium tripolyphosphate. Sodium metasilicate pentahydrate is preferably employed in amounts between about 4 and 8% by weight and offers the advantages of enhanced cleaning effectiveness and additional alkalinity, while also inhibiting corrosion of the metal equipment in the steam cleaning apparatus.

Low foaming nonionic surfactants are employed preferably in amounts between 1 and 3%. Such low foaming nonionic surfactants which are advantageously employed in the composition of this invention include, but are not limited to, the following polyoxyalkylene nonionic surfactants: $C_8$–$C_{22}$normal fatty alcohol-ethylene oxide condensates, i.e., condensation products of one mole of a fatty alcohol containing from eight to 22 carbon atoms with from 3 to 20 moles of ethylene oxide;

polyoxypropylenepolyoxyethylene condensates having the formula $HO(C_2H_4O)_x(C_3H_6O)_y(C_2H_4O)_xH$ where $y$ equals at least 15 and $(C_2H_4O)_{x+x}$ equals 20–90% of the total weight of the compound; alkyl polyoxypropylenepolyoxyethylene condensates having the formula $RO(C_3H_6O)_x(C_2H_4O)_yH$ where R is a $C_1$–$C_{15}$ alkyl group and $x$ and $y$ represent an integer from 2 to 98; polyoxyalkylene glycols having a plurality of alternating hydrophobic and hydrophilic polyoxyalkylene chains, the hydrophilic chains consisting of linked oxyethylene radicals and the hydrophobic chains consisting of linked oxypropylene radicals, said product having three hydrophobic chains, linked by two hydrophilic chains, the central hydrophobic chain constituting 30% to 34% by weight of the product, the terminal hydrophobic chains together constituting 31% to 39% by weight of the product, the linking hydrophilic chains together constituting 31% to 35% by weight of the product, the intrinsic viscosity of the product being from 0.06 to 0.09 and the molecular weight being from about 3,000 to 5,000 (all as described in U.S. Pat. No. 3,048,548); butylene oxide capped alcohol ethoxylates having the formula $R(OC_2H_4)_y(OC_4H_9)_xOH$ where R is a $C_8$–$C_{18}$ alkyl group and $y$ is an integer from about 3.5 to 10 and $x$ is an integer from about 0.5 to 1.5; benzyl ether of polyoxyethylene condensates of alkyl phenols having the formula

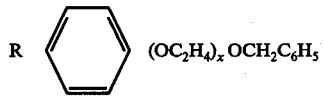

where R is a $C_6$–$C_{20}$alkyl group and $x$ is an integer from 5 to 40; alkyl ethers of polyoxyethylene condensates of alkyl phenols having the formula

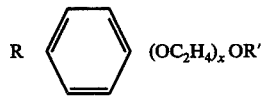

where R is a $C_6$-$C_{12}$ alkyl group, R′ is a $C_4$-$C_{12}$ alkyl group and $x$ is an integer from 5 to 40; and alkyl phenoxy polyoxyethylene ethanols having the formula

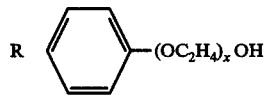

where R is a $C_8$-$C_{20}$alkyl group and $x$ is an integer from 3 to 20. Other low foaming nonionic surfactants are suitable for use in the herein-disclosed composition and it is not intended to exclude any of such surfactants.

Particularly preferred formulations will also contain minor amounts of a fluorescent whitening agent, that is, about 0.1 to 1%, preferably 0.5 to 0.8% by weight. Fluorescent whitening agents suitable for use in the composition of this invention include, but the not limited to amino coumarins as 7-Dimethylamino-4-methylcoumarin and 7-Diethylamino-4-methylcoumarin; diaminostilbenedisulfonic acid-cyanuric chlorides as 4,4′-Bis[(4,6-dianilino-s-triazin-2-yl)amino]-2,2′-stilbenedisulfonic Acid, 4,4′-Bis{{4-anilino-6-[bis (2-hydroxyethyl)amino]-s-triazin-2-yl}amino}-2,2′-stilbenedisulfonic Acid, 4,4′-Bis[(4-anilino-6-morpholino-s-triazin-2-yl)amino]-2,2'-stilbenedisulfonic Acid and 4,4'-Bis[[4-anilino-6[(2-hydroxyethyl)amino]-s-triazin-2-yl]amino]-2,2'-stilbenedisulfonic acid disodium salt; naphthotriazolylstilbenes as 4-(2H-Naphtho[1,2-d] triazol-2yl)-2-stilbenesulfonic acid, Na salt; pyrazolines as p-[3-(p-Chlorophenyl)-2-pyrazolin-1-yl]-benzenesulfonamide; and styrylnaphthoxazoles as 2-Styrylnaphth[1,2-d]oxazole.

The above specifically mentioned fluorescent whitening agents are commercially available materials and are described in the American Society for Testing and Materials technical publication DS53 entitled "List of Fluorescent Whitening Agents for the Soap and Detergent Industry."

Water is generally present in the carpet cleaning concentrate in amounts up to about 5% by weight. Preferably about 1% by weight of water is present in the concentrate. Such amounts of water have an anticaking effect on the composition and produce a dry granular concentrate.

Other additives may optionally be present in the above described carpet cleaning concentrate. Such optional additives include coloring agents, and antimicrobial agents as for example 3,4,5-tribromo-salisylanilide.

The compositions as such are suitable concentrates for use in connection with the steam cleaning of carpeting. When applied to carpeting in the steam cleaning process, they are in the form of hot dilute aqueous solutions and such solutions, as they are applied to the carpeting, generally have a concentration of about 0.1 to 3% by weight, preferably between about 0.25 to 0.75%. Thus, a further embodiment of the present invention resides in a method for cleaning carpeting comprising applying to the carpeting under pressure a hot aqueous solution of the carpet cleaning concentrate for a period of about 1 to 5 seconds and recovering the solution with a vacuum device after it has contacted the carpeting.

The invention is further illustrated by the following example which should not be considered as limitative of its scope. Percentages are by weight.

EXAMPLE 1

The following formulation was prepared by dry blending the ingredients and had the following composition: sodium tripolyphosphate, 91.3%, sodium metasilicate pentahydrate, 5.0%; butyl ether of polyoxyethylated octyl phenol (sold as Triton ® CF-54), 2.0%; 4-(2H-Naphtho[1,2-d] triazol-2-yl)-2-stilbenesulfonic acid, Na salt, fluorescent whitening agent (sold as Tinopal ® RBS 200%), 0.7%; water, 1.0%. The formulation was employed in a conventional carpet steam cleaning machine at a concentration of about 0.5% in water and excellent cleaning effectiveness with no foaming problems was observed.

What is claimed is:

1. A carpet cleaning concentrate consisting essentially of by weight: (a) sodium tripolyphosphate, 75 to 95%; (b) sodium metasilicate pentahydrate, 3 to 10%; (c) a low-foaming nonionic surfactant, 0.5 to 10%, said nonionic surfactant being selected from the group consisting of (a) condensation products of one mole of a $C_8$–$C_{22}$ normal fatty alcohol with from 3–20 moles of ethylene oxide, (b) polyoxypropylene-polyoxyethylene condensates having the formula $HO(C_2H_4O)_x(C_3H_6O)_y(C_2H_4O)_xH$ where $y$ equals at least 15 and $(C_2H_4O)_{x+x}$ equals 20–90% of the total weight of the condensate, (c) alkyl polyoxypropylene-polyoxyethylene condensates having the formula $RO\text{-}(C_3H_6O)_x(C_2H_4O)_yH$ where R is a $C_1$–$C_{15}$ alkyl group and x and y represent an integer from 2 to 98, (d) polyoxyalkylene glycol compounds having a plurality of alternating hydrophobic and hydrophilic polyoxyalkylene chains, the hydrophilic chains consisting of linked oxyethylene radicals and the hydrophobic chains consisting of linked oxypropylene radicals, said compounds having three hydrophobic chains, linked by two hydrophilic chains, the central hydrophobic chain constituting 30 to 34% by weight of said compounds in which the terminal hydrophobic chains together constitute 31–39% by weight of said compounds, the linking hydrophilic chains together constituting 31 to 35% by weight of said compounds, the intrinsic viscosity of said compounds being from 0.06 to 0.09 with the molecular weight being from about 3,000 to 5,000, (e) butylene oxide capped alcohol ethoxylates having the formula $R(OC_2H_4)_y(OC_4H_9)_xOH$ where R is a $C_8$–$C_{18}$ alkyl group and $y$ is an integer from about 3.5 to 10 and $x$ is an integer from about 0.5 to 1.5, (f) benzyl ethers of polyoxyethylene condensates of alkyl phenols having the formula

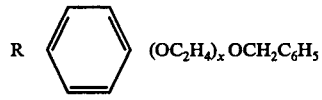

where R is a $C_6$–$C_{20}$ alkyl group and $x$ is an integer from 5 to 40, (g) alkyl ethers of polyoxyethylene condensates of alkyl phenols having the formula

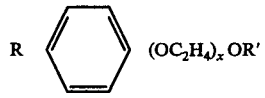

where R is a $C_6$–$C_{12}$ alkyl group, R' is a $C_4$–$C_{-12}$ alkyl group and $x$ is an integer from 5 to 40, and (h) alkyl phenoxy polyoxyethylene ethanols having the formula

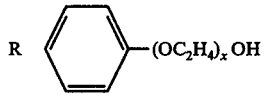

where R is a $C_8$–$C_{20}$ alkyl group and $x$ is an integer from 3 to 20; (d) water, 0 to 5%.

2. The composition of claim 1 additionally containing 0.1 to 1% of a fluorescent whitening agent selected from the group consisting of amino coumarins, diaminostilbenedisulfonic acid-cyanuric chlorides, naphthotriazolylstilbenes, pyrazolines, and styrylnaphthoxazoles.

3. The composition of claim 1 where there is present between about 88 and 92% by weight of sodium tripolyphosphate.

4. The composition of claim 1 where there is present between about 4 to 8% of sodium metasilicate pentahydrate.

5. The composition of claim 1 where there is present between about 1 and 3% of said nonionic surfactant.

* * * * *